US006661182B2

(12) United States Patent
Sridharan

(10) Patent No.: US 6,661,182 B2
(45) Date of Patent: Dec. 9, 2003

(54) LAMP BALLAST SYSTEM HAVING IMPROVED POWER FACTOR AND END-OF-LAMP-LIFE PROTECTION CIRCUIT

(75) Inventor: Sri Sridharan, Hickory Hills, IL (US)

(73) Assignee: Radionic Industries, Inc., Chicago, IL (US)

( * ) Notice: Subject to any disclaimer, the term of this patent is extended or adjusted under 35 U.S.C. 154(b) by 0 days.

(21) Appl. No.: 10/115,342

(22) Filed: Apr. 3, 2002

(65) Prior Publication Data

US 2003/0189411 A1 Oct. 9, 2003

(51) Int. Cl.[7] ..... H05B 41/46; H05B 37/02

(52) U.S. Cl. ..... 315/224; 315/224; 11/307; 11/219

(58) Field of Search ..... 315/224, 209 R, 315/219, 307, 291, 308, 247, 248, DIG. 2, 220, 240, 276, 278, DIG. 4, DIG. 5, DIG. 7; 363/16, 21

(56) References Cited

U.S. PATENT DOCUMENTS 4,560,908 A * 12/1985 Stupp et al. ..... 315/219
5,099,082 A * 3/1992 Bolmer et al. ..... 570/180
5,404,082 A * 4/1995 Hernandez et al. ..... 315/219
5,416,387 A * 5/1995 Cuk et al. ..... 315/209 R
5,619,404 A * 4/1997 Zak ..... 363/21.09
5,836,943 A * 11/1998 Miller, III ..... 606/34
6,008,589 A * 12/1999 Deng et al. ..... 315/209 R

* cited by examiner

*Primary Examiner*—Don Wong
*Assistant Examiner*—Chuc Tran
(74) *Attorney, Agent, or Firm*—Sonenschein, Nath & Rosenthal LLP

(57) ABSTRACT

A ballast system for use with a fluorescent lamp having two filaments disposed at opposite ends of the lamp. The ballast system has a DC input terminal for connection to a DC voltage source or for receiving a rectified DC signal. The ballast system also includes a capacitor operably connected between the DC input terminal and the lamp and an inductor, wherein the lamp operably connects the capacitor in series with the inductor. The ballast system further includes a first power transistor operably connected to a junction joining the DC input terminal to the capacitor and a second power transistor operably connected to drive the first power transistor. The emitter of the first power transistor and the collector of the second power transistor are operably connected to the inductor such that the two power transistors sense a change in voltage across the inductor and control current from the DC voltage source to the capacitor in response to a change in voltage across the inductor.

21 Claims, 3 Drawing Sheets

LAMP BALLAST SYSTEM HAVING IMPROVED POWER FACTOR AND END-OF-LAMP-LIFE PROTECTION CIRCUIT

FIELD OF THE INVENTION

The present invention relates to fluorescent lamps, and more particularly, to ballast circuits for fluorescent lamps including a self-oscillation circuit having a high power factor and an end-of-lamp-life protection circuit.

BACKGROUND OF THE INVENTION

In the lighting of fluorescent lamps, a gas enclosed within a glass tube is caused to become ionized, thus reducing a breakdown voltage between electrodes placed at opposite ends of the glass tube. Ionization is initiated by heating of the electrodes. Once the gas is sufficiently ionized, a voltage at or above the breakdown voltage is placed across the lamp electrodes to thereby cause a current arc to form across the electrodes. The arc produces a bright glow within the lamp tube and produces radiation that activates a fluorescent coating on the inner surface of the glass tube, to thereby produce a bright light.

In controlling the turning on and off of fluorescent lamps, it is necessary to control the current to the lamp and to provide a starting voltage. In fluorescent lamps, this task is performed by a circuit called a ballast, also referred to as a ballasting circuit. There are generally two types of ballasts: magnetic ballasts and electronic ballasts.

Presently, most low wattage fluorescent lamps utilize magnetic ballasts that include magnetic chokes or suitable magnetic transformers and glow bulb starters. The magnetic choke limits current flow to the lamp while the glow bulb starter creates a voltage spike across the lamp after sufficiently preheating the electrodes. These magnetic ballasts are considered inefficient because of considerable power dissipation in the magnetic components. Moreover, these ballasts exhibit low power factors because of the highly inductive reactances of the magnetic chokes. The power factor is the ratio of the average (or active) power to the apparent power (root-mean-square [rms] voltages times rms current) of an alternating circuit.

Further, the glow bulb starters associated with these ballasts exhibit random starting times that produce unpleasant flashes or flickering as an arc attempts to be established across the electrodes of the lamp. This is especially true at low line voltages because the ballasts permit too much voltage to be applied to the bulbs, due to the inadequacies in the ballast design. Arcs are then produced across the bimetal components of the bulbs as the voltage will be nearly high enough to sustain arcing, and annoying flickering and restriking occurs. As a result, the performances of glow bulb starters are not predictable and this results in unreliable starting times of the fluorescent lamps.

Electronic ballasts are very expensive and can suffer from poor reliability due to the larger number of components involved. In these ballasts, a variety of electronic components are utilized to heat up the electrodes of the lamp and to establish the breakdown voltage across the electrodes. In addition, in conventional electronic ballasts a large number components, including integrated circuit components, are required to control the power factor of the conventional electronic ballasts (i.e., See Wang et al., U.S. Pat. No. 6,300,723).

Magnetic ballasts have reliability problems after 6,000 cycles because of contact wearout in the associated glow bulb starters therewith. Electronic ballasts suffer from similar reliability problems because of the larger number of discrete components used.

In addition, to meet Underwriters Laboratory, Inc. safety standards for current leakage of an electronic ballast while replacing a lamp (i.e., relamping), there is a need for an electronic circuit that is able to sufficiently protect against current leakage during relamping without using a large number of components and while still having a high power factor correction.

SUMMARY OF THE INVENTION

To overcome the above identified problems of a conventional ballast circuit, a ballast system consistent with the present invention is provided that has an improved power factor resulting in a more efficient operation of a lamp. Furthermore, the ballast system also detects end-of-lamp-life of a lamp to protect against high voltage conditions that may occur as the lamp fails to draw sufficient current.

In accordance with articles of manufacture consistent with the present invention, a ballast system for use with a fluorescent lamp having two filaments disposed at opposite ends of the lamp is provided. The ballast system includes a DC input terminal for connection to a DC voltage source or for receiving a rectified DC signal, a capacitor operably connected between the DC input terminal and the lamp, and an inductor. The lamp operably connects the capacitor in series with the inductor. The ballast system also includes a switching means that is operably connected to the DC input terminal and to the capacitor for sensing a change in voltage across the inductor and for controlling current from the DC voltage source to the capacitor in response to the change in voltage across the inductor. The switching means controls the current to the capacitor such that the current has a waveform and a frequency that is preferably approximately equal to a series resonant frequency defined by the capacitor and the inductor.

The ballast system may also include an electronic starter circuit operably connected between the switching means and the DC input terminal such that the electronic starter circuit triggers the operation of the switching means when the predetermined voltage level is present on the DC input terminal.

The ballast system may also include a startup capacitor operably connected between the two filaments of the lamp and a startup resistor operably connected in parallel to the startup capacitor. In this implementation, the ballast system may further include an end-of-lamp-life sensor operably connected across one of the two filaments of the lamp. The end-of-lamp-life sensor is operably configured to detect when a second predetermined voltage level is present at one end of the one filament of the lamp and to momentarily substantially short the one filament causing a pulse with a predetermined magnitude to be sent through the inductor to the switching means when the second predetermined voltage level is detected.

The ballast system may further include an end-of-lamp-life cutoff circuit and a transformer that has the inductor as a primary winding and that has a secondary winding. In this implementation, the end-of-lamp-life cutoff circuit is operably connected to the secondary winding and to the switching means. The end-of-lamp-life cutoff circuit also has means for causing the switching means to inhibit current flow to the lamp when the pulse with the predetermined magnitude is sent through the inductor and sensed via the secondary winding.

BRIEF DESCRIPTION OF THE DRAWINGS

The accompanying drawings, which are incorporated in and constitute a part of this specification, illustrate an implementation of the present invention and, together with the description, serve to explain the advantages and principles of the invention. In the drawings.

DETAILED DESCRIPTION OF THE INVENTION

A ballast system embodying principles of the present invention has an improved power factor resulting in a more efficient operation of a lamp. Furthermore, the ballast system may also detect the end-of-lamp-life of the lamp to protect against high voltage conditions that may occur as the lamp fails to draw sufficient current.

Figure 1:
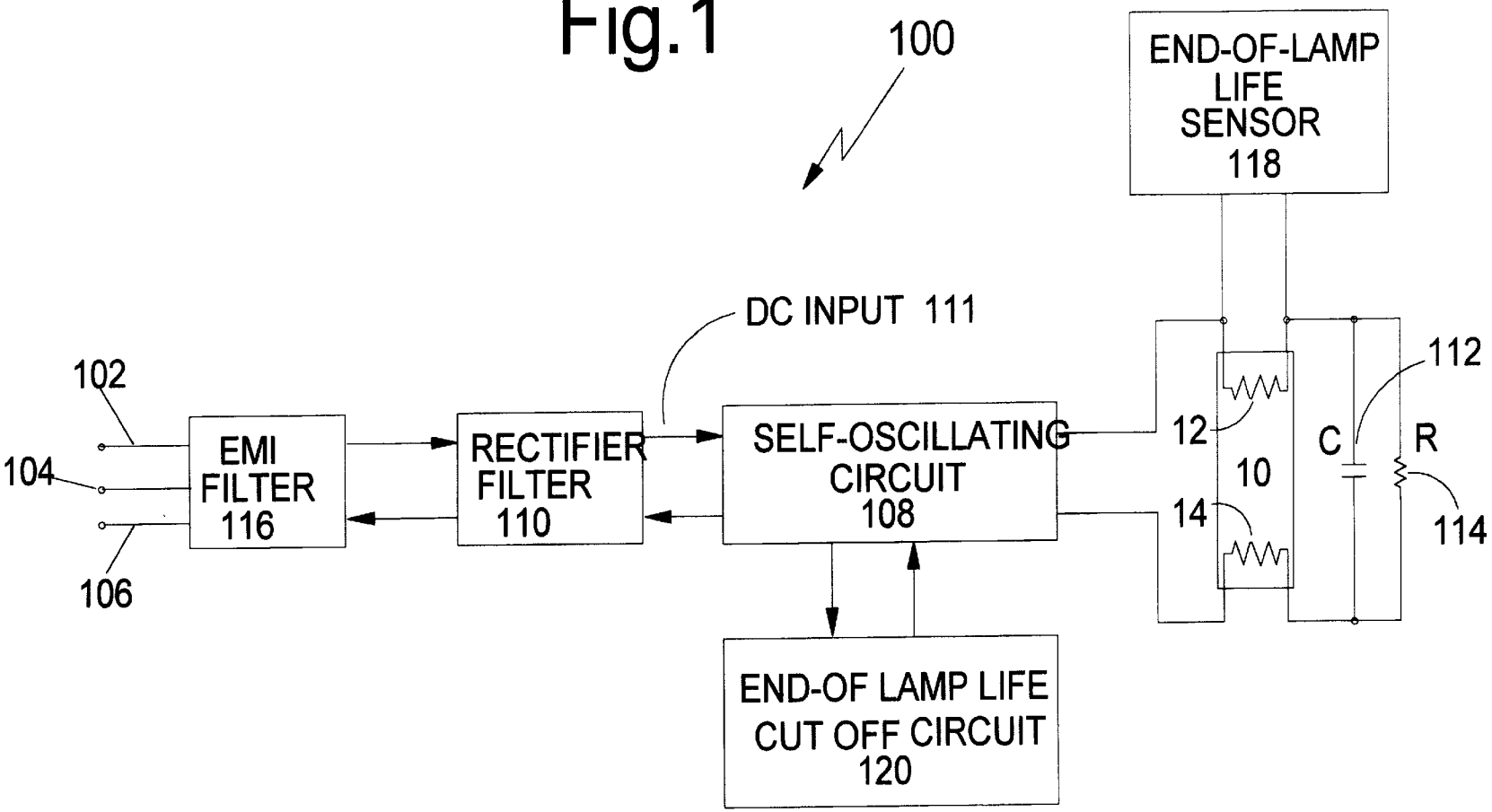
FIG. 1 depicts a block diagram of an exemplary ballast system embodying aspects of the present invention for energizing a fluorescent lamp and detecting an end-of-life for the fluorescent lamp.

FIG. 1 depicts a block diagram of an exemplary ballast system 100 embodying aspects of the present invention. The ballast system 100 is operably connected, such as through electrical and/or optical connections, to a fluorescent lamp 10 having electrodes or filaments 12 and 14. Lamp 10 may be any standard interchangeable fluorescent lamp, such as ones configured to meet the known designation F8T5 (i.e., fluorescent 8 Watt, ⅝ inch diameter) or F13T5 (i.e., fluorescent 8 Watt, ⅝ inch diameter).

The ballast system 100 includes terminals 102 and 104 that are configured to be operably connected to an incoming alternating current (AC) source for powering the lamp 10. The ballast system 100 may also include another terminal 106 for operably connecting the ballast system 100 to house or earth ground.

The ballast system 100 further includes a self-oscillating circuit 108 that is operably connected to the lamp 10 and that has a DC input terminal 111. The ballast system 100 may also include a rectifier filter 110 that is operably connected to terminals 102 and 104 and to the DC input terminal 111 of the self-oscillating circuit 108 as shown in FIG. 1. As described in greater detail below, the self-oscillating circuit 108 provides a starting voltage and current limitation to the lamp 10 while exhibiting a high power factor correction, such as 95% or more. The rectifier filter 110 converts an AC signal when present on terminals 102 and 104 to a DC signal having substantially small amount of ripple or periodic variations in voltage for input (i.e., via DC input terminal 111) into self-oscillating circuit 108.

In another implementation, self-oscillating circuit 108 may be operably connected to a DC voltage source (not shown in figures), such as a battery, in lieu of the rectifier 110.

The ballast system 100 may also include a startup capacitor 112 operably connected in series with filaments 12 and 14 of the lamp 10, and a resistor 114 coupled across the capacitor 112. The startup capacitor 112 determines the level of preheat current through filaments 12 and 14 when the starting voltage is provided by the self-oscillating circuit 108 to the lamp 10 and current is permitted to flow through the filaments 12 and 14 to light the lamp 10 or between the filaments 12 and 14 within the lamp once the lamp 10 is lit in response to an arc struck between the filaments 12 and 14.

The resistor 114 acts a bleeder resistor to discharge or reduce the voltage held by the capacitor 112 to a safe level when the starting voltage to the lamp 10 is removed (e.g., AC power source switched or turned off) or the lamp 10 itself is removed. The resistor 114 preferably has a significantly higher level of resistance than the lamp 10 when lit such that current flows substantially through the lamp 10 between filaments 12 and 14 and not through resistor 114 when the lamp is lit. In one implementation, the resistor 114 is a thermistor that changes, preferably increases, resistance with a change, preferably a positive change, in temperature.

In one implementation, the ballast system 100 may also include an electromagnetic interference (EMI) filter 116 operably connected between the rectifier filter 110 and terminals 102 and 104. The EMI filter 116 is preferably configured to prevent electromagnetic radiation frequencies or transient power surges on terminals 102 and 104 from interrupting the operation of self-oscillating circuit 102 and from degrading the high power correction of the self-oscillating circuit 108.

In addition, the ballast system 100 may also include an end-of-lamp-life sensor 118 and an end-of-lamp-life cutoff circuit 120. The end-of-lamp-life sensor 118 is operably connected across one of the filaments 12 or 14 and is configured to detect an over-voltage condition or second predetermined voltage level (e.g., at or above 30 V) that indicates the lamp 10 is no longer drawing a sufficient amount of current through the lamp. When the over-voltage condition is detected, the end-of-lamp-life sensor 114 shorts the one filament (e.g., filament 12) of the lamp 10 and sends a pulse to the self-oscillating circuit 102 via resistor 114 to indicate that the over-voltage condition has been detected.

As explained in greater detail below, the end-of-lamp-life cutoff circuit 120 is operably connected to the self-oscillating circuit 102 such that end-of-lamp-life cutoff circuit 120 is able to monitor for the pulse from the end-of-lamp-life sensor and to cutoff or disable current flow from the self-oscillating circuit 102 to the lamp 10 in response to receiving the pulse.

Figure 2:
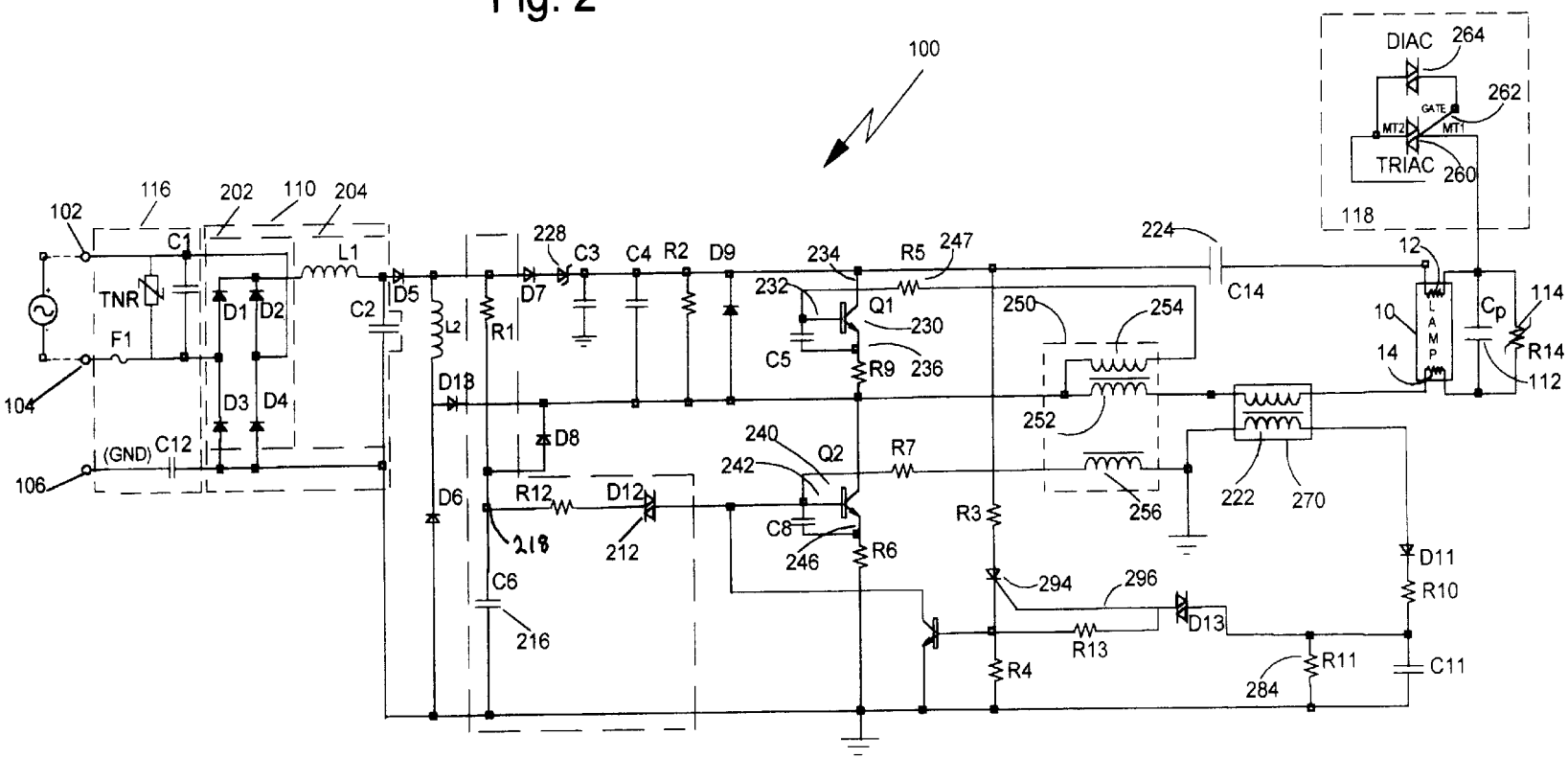
FIG. 2 depicts an exemplary schematic diagram of the ballast system in FIG. 1.

FIG. 2 depicts an exemplary schematic diagram of the ballast system 100. As shown in FIG. 2, the rectifier filter 110 includes a full-wave rectifier 202, which may be a full-wave bridge rectifier using a common arrangement of diodes D1–D4 as shown in FIG. 2, that is operably connected to terminals 102 and 104. The rectifier filter 110 may also include a low-pass filter 204 operably connected between the full-wave rectifier 202 and the self-oscillating circuit 108. The full-wave rectifier 202 and the low-pass filter 204 combine to output (i.e., via DC input terminal 111) to the self-oscillating circuit 108 a rectified DC signal having little or no ripple voltage when an AC signal is present on terminals 102 and 104.

Self-oscillating circuit 102 includes an electronic starter circuit 210 and an oscillation control circuit 220. The electronic starter circuit 210 is operably connected to the DC input terminal 111 and to the oscillation control circuit 208 such that the electronic starter circuit 210 triggers the operation of the oscillation control circuit 220 when the rectified DC signal reaches a predetermined voltage level, which is preferably the starting voltage of the lamp 10.

Electronic starter circuit 210 includes a trigger circuit 212, such as a silicon controlled rectifier (SCR), DIAC, TRIAC, or SIDAC, that operably connects the DC input terminal 111 to a base 242 of a power transistor 240 of the oscillation control circuit 220 when the rectified DC signal reaches the predetermined voltage level so that the power transistor 240 turns on, allowing current to be supplied to the lamp 10 as described in detail below. In the implementation shown in FIG. 2, the electronic starter circuit 210 may also include a resistor 214 operably connected to the DC input terminal 111 and a capacitor 216 operably connected in series with the resistor 214. In this implementation, the triggering circuit 212 is operably connected to a junction 218 between the resistor 214 and the capacitor 216 such that the capacitor 216 charges to the predetermined voltage in a predetermined time based on the value of the resistor 214 and the value of the capacitor 216.

As shown in FIG. 2, the oscillation control circuit 220 has a choke circuit 222 that includes a capacitor 224 operably connected in series with the lamp 10 (or load for the ballast system 100) and a ballasting choke or inductor 226, which acts to choke or prevent any rapid change in the flow of current to the lamp 10 from the power source. The capacitor 224 and the inductor 226 form a series resonant circuit having a low resonant impedance such that the capacitor 224 compensates for the inductance of the inductor 226 and the resistance of the lamp 10 when the lamp 10 is lit, resulting in a high power factor correction of 95% or more for the oscillation control circuit 220. In addition, because the electronic starter circuit 210 and the startup capacitor 112 allow for a short or rapid turn-on time of about 200 milliseconds for lighting the lamp 10, any power factor phase shift is eliminated, which contributes to the high power factor correction. To achieve a high power factor correction of 95% or more, capacitor 224 may have a value in the approximate range of 47 nF±5%, while inductor 226 has a corresponding value in the approximate range of 5.6 mH±5%. In one implementation, capacitor 224 may a value of approximately 47 nF and inductor 226 may have a value of approximately 5.7 mH. In this implementation, capacitor 224 and inductor 226 may be rated to handle voltages up to 600 V as the oscillation control circuit 220 steps up the voltage level supplied by the AC source on terminals 102 and 104 while stepping down the current supplied to the lamp 10.

The self-oscillating circuit 108 may also include a clamp 228, such as a zener diode, that is operably connected between the DC input terminal 111 and the capacitor. The clamp 228 limits the maximum voltage level presented to capacitor 224 such that other commercially available capacitors with voltage ratings less than 600 V (e.g., 400V) may be used for capacitor 224.

The oscillation control circuit 220 also includes a first power transistor 230 operably connected to a junction joining the DC input terminal 111 to the capacitor 224 and the second power transistor 240 operably connected to drive the first power transistor 230 such that the first power transistor 230 in combination with the second power transistor 240 rapidly switch or oscillate current (and thus power) to the lamp 10 in a substantially sinusoidal waveform at a frequency that corresponds to the series resonant frequency formed by capacitor 224 and inductor 226. In the example implementation shown in FIG. 2, the first and the second power transistors 230 and 240 each have a respective base 232 and 242 that is operably connected to the inductor 226, such that each power transistor 230 and 240 switch or oscillate current to the lamp 10 in association with the current through the inductor 226 and corresponding change in voltage across the inductor 226.

To facilitate self-oscillation of the oscillation control circuit 220 (once the second power transistor 240 has been triggered by the electronic starter circuit 210 to turn on) in the implementation shown in FIG. 2, a first terminal or collector 234 of the first power transistor 230 is operably connected to the junction joining the DC input terminal 111 to the capacitor 224, a first terminal or collector 244 of the second power transistor 240 is operably connected to a second terminal or an emitter 236 of the first power transistor, and a second terminal or an emitter 246 of the second power transistor is operably connected to ground.

To further facilitate self-oscillation, the oscillation control circuit 220 also includes a transformer 250 having a primary winding 252 and two secondary windings 254 and 256. The primary winding 252 is operably connected in series between the inductor 226 and a junction joining the emitter 236 of the first power transistor 230 to the collector of the second power transistor. The first 254 of the two secondary windings 254 and 256 is operably connected to the base 232 of the first power transistor 230 such that an output signal from the collector 234 oscillates in association with the change in voltage across the inductor 226. In addition, the second 256 of the two secondary windings 254 and 256 is operably connected to the base 242 of the second power transistor 230 such that an output signal from the collector 244 also oscillates in association with the change in voltage across the inductor 226. Thus, the respective collector output (234 and 244) of each power transistor 230 and 240 continues to oscillate as the current to each respective base input (232 and 242) is driven through respective secondary windings 254 and 256 when the lamp 10 is lit as described above.

The oscillation control circuit 220 may also include a resistor 247 operably connected in series between the power transistor base 232 and the secondary winding 254, and a resistor 248 operably connected in series between the power transistor base 242 and the secondary winding 256. The resistors 247 and 248 each have a respective predetermined value to limit current to the respective base 232 and 242 such that the respective collector output (234 and 244) of each power transistor 230 and 240 continues to oscillate once the electronic starter circuit 210 triggers the operation of the oscillation control circuit 220.

FIG. 2 also depicts an exemplary implementation of the end-of-lamp-life sensor 118 and the end-of-lamp-life cutoff circuit 120 of the ballast system 100. In this implementation, the end-of-lamp-life sensor 118 includes a first switch 260 that has a control input 262, such as a TRIAC, and a second switch 264 that is normally open, such as a DIAC. The first switch 260, which is also normally open, is operably coupled across the filament 12 of the lamp 10. The second switch 264 is operably connected to the control input 262 of the first switch 260 and to a junction joining the capacitor 224 of the oscillation control circuit 220 to one end of the filament 12. In this implementation, the second switch 264 is configured to detect an over-voltage condition or second predetermined voltage level (e.g., at or above 30 V) at the one end of the filament 12 of the lamp 10 that indicates the lamp 10 is no longer drawing a sufficient amount of current through the lamp. When the over-voltage condition is detected, the second switch 264 closes causing the first switch 260 to close momentarily so that the filament 12 of the lamp 10 is substantially shorted, allowing a pulse having a predetermined magnitude to be sent via resistor 114 to the inductor 226 which is then sensed by the end-of-lamp-life circuit 120.

In another implementation, in lieu of the first and second switches, the end-of-lamp-life sensor may include a single switch, such as a SIDAC, operably connected across the filament 12 and that is capable of momentarily closing when an over-voltage condition is detected.

As shown in FIG. 2, the oscillation control circuit 220 may also include a transformer 270 in which the inductor 226 is a primary winding of the transformer 270. The transformer 270 has a secondary winding 272 or inductor that is operably connected to the end-of-lamp-life cutoff circuit 120, such that the end-of-lamp-life cutoff circuit 120 is able to monitor for the pulse having the predetermined magnitude.

Continuing with FIG. 2, the end-of-lamp-life cutoff circuit 120 has a third switch 280, operably connected between the secondary winding 272 of transformer 270 and the base 242 of the power transistor 240. The third switch 280 may be any switch (such as a DIAC, TRIAC, or other SCR) that is capable of switching to a closed state upon detection of a pulse having the predetermined magnitude. In this implementation, when the third switch 280 is in the closed state, the power transistor 240 turns off causing the power transistor 230 to also turn off, which inhibits current flow from the oscillation control circuit 120 to the lamp 10.

The end-of-lamp-life cutoff circuit 120 may also include a capacitor 282 operably connected to a junction joining the third switch 280 to the secondary winding 272 and a resistor 284 connected across the capacitor 282. The capacitor 282 charges to the predetermined magnitude of a detected pulse and discharges at a rate associated with the value of the resistor 284. Thus, the capacitor 282 and the resistor 284 may combine to hold the third switch 280 in the closed state for a predetermined time sufficient to turn off the power transistor 240.

In a preferred implementation, the end-of-lamp-life cutoff circuit 120 includes a transistor 290, preferably a small signal transistor, that is operably connected between the third switch 280 and the base 242 of the power transistor 240, such that the transistor 290 sufficiently lowers the voltage on (e.g., grounds) the base 242 of the power transistor 240 when the third switch 280 is in the closed state. In this implementation, the end-of-lamp-life cutoff circuit 120 may include the capacitor 282 and the resistor 284 operably configured to hold the third switch 280 in the closed state for a predetermined time sufficient to turn on the transistor 290 so that the power transistor 240 is turned off as described above.

As shown in FIG. 2, the end-of-lamp-life cutoff circuit 120 may also include a fourth switch 294 having a control input 296 operably connected to the third switch 280 such that the fourth switch is operable when the third switch is closed (i.e., when a pulse having the predetermined magnitude is detected). The fourth switch 294 is operably connected to the collector 234 of the power transistor 230 and to a junction joining the third switch 280 to base of the transistor 290. The fourth switch 294 is operably configured to close and rapidly direct current flow away from the lamp 10 to ground via transistor 290 when a pulse having the predetermined magnitude is detected as described above, causing the third switch to momentarily close.

Figure 3:
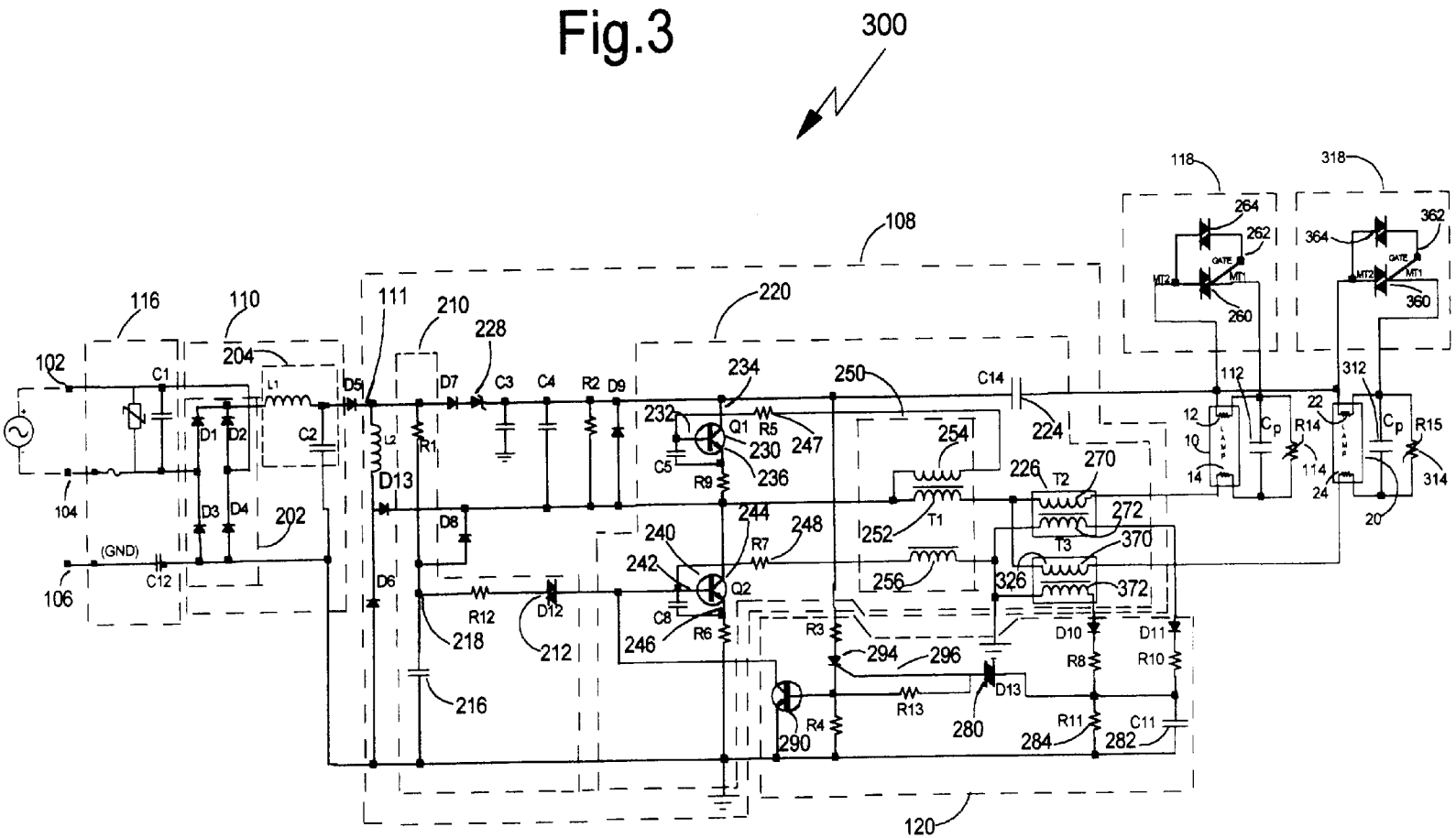
FIG. 3 depicts a schematic diagram of another exemplary ballast system for two or more fluorescent lamps embodying aspects of the present invention for energizing two or more fluorescent lamps and detecting an end-of-life for the two or more fluorescent lamps.

FIG. 3 depicts a schematic diagram of another exemplary ballast system 300 embodying aspects of the present invention for energizing two or more fluorescent lamps and detecting an end-of-life for the two or more fluorescent lamps. As shown in FIG. 3, the ballast system 300 incorporates the ballast system 100 in FIG. 2. In addition, the ballast system 300 is operably connected to a second fluorescent lamp 20 having filaments 22 and 44 such that the ballast system 300 supplies current to both lamps 10 and 20 once the electronic starter circuit 210 triggers the operation of the oscillation control circuit 220.

The oscillation control circuit 220 of the ballast system 300 has a second ballasting choke or inductor 326 operably connected in series with the lamp 20. The inductor 326, which may be of the same type and have the same value as the inductor 226, acts to choke or prevent any rapid change in the flow of current to the lamp 20 from the power source. In addition, the inductor 226 and lamp 10 are connected in parallel with the inductor 326 and the lamp 20 so that combination of inductors 226 and 326 and lamps 10 and 20 forms a series resonant circuit with the capacitor 224. The series resonant circuit has a low resonant impedance such that the capacitor 224 compensates for the inductance of both inductors 226 and 326 making the current more or less in phase with the voltage provided to the lamps 10 and 20 when the lamps 10 and 20 are lit. As a result, the oscillation control circuit 220 has a high power factor correction of 95% or more when supplying power to the lamps 10 and 20.

Once the electronic starter circuit 210 triggers the operation of the oscillation control circuit 220 in the ballast system 300, collector outputs 234 and 244 of power transistors 230 and 240 of ballast system 300 oscillate current supplied to lamps 10 and 20 as described above in reference to ballast system 100 as the current to base inputs 232 and 242 is driven through respective secondary windings 254 and 256.

As shown in FIG. 3, the ballast system 300 may also include a second startup capacitor 312 operably connected in series with filaments 22 and 24 of the lamp 20, and a resistor 314 coupled across the capacitor 312. The startup capacitor 312, which may be of the same type and have the same value as the capacitor 212, determines the level of preheat current through filaments 22 and 24 when the starting voltage is provided by the self-oscillating circuit 108 to the lamp 20 and current is permitted to flow through the filaments 22 and 24 to light the lamp 20 or between the filaments 22 and 24 within the lamp once the lamp 20 is lit in response to an arc struck between the filaments 22 and 24.

The resistor 314 operates similarly to resistor 114, acting as a bleeder resistor to discharge or reduce the voltage held by the capacitor 312 to a safe level when the starting voltage to the lamp 20 is removed (e.g., AC power source switched or turned off) or the lamp 20 itself is removed. The resistor 314 preferably has a significantly higher level of resistance than the lamp 20 when lit such that current flows substantially through the lamp 20 between filaments 22 and 24 and not through resistor 314 when the lamp 20 is lit.

As shown in FIG. 3, the ballast system 300 may also include another end-of-lamp-life sensor 318 operably coupled across one (e.g., filament 22) of the filaments 22 and 24. The end-of-lamp-life sensor 318, which operates in the same manner as the end-of-lamp-life sensor 118, is operably configured to detect an over-voltage condition or second predetermined voltage level (e.g., at or above 30 V) at the one end of the filament 22 of the lamp 20, indicating that the lamp 20 is no longer drawing a sufficient amount of current through the lamp 20. When the over-voltage condition is detected by the end-of-lamp-life sensor 318, the end-of-lamp-life sensor 318 generates a pulse having a predetermined magnitude to be sent via resistor 314 to the inductor 326 which is then sensed by the end-of-lamp-life circuit 120.

To allow the end-of-lamp-life cutoff circuit 120 to sense the pulse from the end-of-lamp-life sensor 318, the oscillation control circuit 220 may also include a second transformer 370 in which the inductor 326 is a primary winding of the transformer 370. The transformer 370 has a secondary winding 372 or inductor that is operably connected to the oscillation control circuit 220, such that the that the end-of-lamp-life cutoff circuit 120 is able to monitor for or sense a pulse from the end-of-lamp-life sensor 318 that has the predetermined magnitude. In the implementation shown in FIG. 3, the secondary winding 372 of transformer 370 is operably connected to the third switch 280 of the end-of-lamp-life cutoff circuit 120, such that a pulse from either end-of-lamp-life sensors 118 or 318 that has the predetermined magnitude causes the third switch 280 to close, such that the second power transistor turns off and current flow to both lamps 10 and 20 is inhibited. Thus, when either lamp 10 or lamp 20 is removed or reaches an end-of-lamp-life state (i.e., an over voltage condition exists is association with the respective lamp 10 or 20), the ballast system 300 advantageously inhibits current flow to both lamps 10 and 20 until either the missing lamp or lamp at end-of-lamp-life state is replaced.

In an alternative implementation, the ballasting system 300 may include another oscillation control circuit (not shown in figures) operably configured to independently provide current to lamp 20 from the AC current source in the same manner as in ballasting system 100. In this implementation, the ballasting system may also include another end-of-lamp-life cutoff circuit (not shown in figures) to inhibit current flow to lamp 20, independent of current flow to lamp 10, when a pulse having the predetermined magnitude is received from the end-of-lamp-life sensor 318.

While various embodiments of the application have been described, it will be apparent to those of ordinary skill in the art that many more embodiments and implementations are possible that are within the scope of this invention. Accordingly, the invention is not to be restricted except in light of the attached claims and their equivalents.

What is claimed is:

1. A ballast system for use with a fluorescent lamp having two filaments disposed at opposite ends of the lamp, comprising:

a DC input terminal for connection to a DC voltage source;

a capacitor operably connected between the DC input terminal and the lamp;

an inductor, the lamp operably connecting the capacitor in series with the inductor; and a switching means operably connected to the DC input terminal and the capacitor for sensing a chance in voltage across the inductor and for controlling current from the DC voltage source to the capacitor in response to the change in voltage across the inductor, wherein the switching means controls the current to the capacitor such that the current has a sinusoidal waveform and a frequency approximately equal to a series resonant frequency defined by the capacitor and the inductor.

2. A ballast system for use with a fluorescent lamp having two filaments disposed at opposite ends of the lamp, comprising:

a DC input terminal for connection to a DC voltage source;

a capacitor operably connected between the DC input terminal and the lamp;

an inductor, the lamp operably connecting the capacitor in series with the inductor; and a switching means operably connected to the DC input terminal and the capacitor for sensing a change in voltage across the inductor and for controlling current from the DC voltage source to the capacitor in response to the change in voltage across the inductor, wherein the switching means comprises:

a transformer having a primary winding and a secondary winding; and a first power transistor having a first terminal operably connected to the DC input terminal and to the capacitor, a second terminal, and a base terminal operably connected to the secondary winding, the primary winding being operably connected between the inductor and the second terminal of the power transistor.

3. The ballast system of claim 2, wherein the transformer has another secondary winding and the switching means further comprises a second power transistor having a first terminal operably connected to the second terminal of the first power transistor and a base terminal operably connected to the other secondary winding and to the DC input terminal, the second power transistor causing the first power transistor to control current from the DC voltage source to the capacitor when a predetermined voltage level is present on the DC input terminal.

4. The ballast system of claim 3, further comprising a trigger circuit operably connected between the base of the second power transistor and the DC input terminal such that the trigger circuit operably connects the base terminal of the second power transistor to the DC input terminal when the predetermined voltage level is present on the DC input terminal.

5. The ballast system of claim 4, wherein the trigger circuit is incorporated into an electronic starter circuit having a trigger resistor operably connected to the DC input terminal and a trigger capacitor operably connected in series with the trigger resistor, the trigger circuit being operably connected to a junction between the trigger resistor and the trigger capacitor such that the trigger capacitor charges to the predetermined voltage in a predetermined time.

6. A ballast system for use with a fluorescent lamp having two filaments disposed at opposite ends of the lamp, comprising:

a DC input terminal for connection to a DC voltage source;

a capacitor operably connected between the DC input terminal and the lamp;

an inductor, the lamp operably connecting the capacitor in series with the inductor;

a switching means operably connected to the DC input terminal and the capacitor for sensing a change in voltage across the inductor and for controlling current from the DC voltage source to the capacitor in response to the change in voltage across the inductor;

a startup capacitor operably connected between the two filaments of the lamp; and a startup resistor operably connected in parallel to the startup capacitor.

7. The ballast system of claim 6, wherein the startup resistor is a thermistor.

8. The ballast system of claim 6, further comprising an end-of-lamp-life sensor operably connected across one of the two filaments of the lamp, the end-of-lamp-life sensor operably configured to detect when a second predetermined voltage level is present at one end of the one filament and to momentarily substantially short the one filament causing a pulse with a predetermined magnitude to be sent through the inductor to the switching means when the second predetermined voltage level is detected.

9. The ballast system of claim 8, wherein the end-of-lamp-life sensor is a SIDAC.

10. The ballast system of claim 8, wherein the end-of-lamp-life sensor includes a first switch operably connected across the one filament having a control input for controlling the closure of the first switch and a second switch operably connected to the control input and to the one end of the filament, the second switch operably configured to detect when the second predetermined voltage level is present at one end of the one filament and to connect the one end of the filament to the control input of the first switch when the second predetermined voltage is detected.

11. The ballast system of claim 8, wherein the first switch is a DIAC and the second switch is a TRIAC.

12. The ballast system of claim 8, wherein the switching means is adapted to inhibit current flow to the lamp when the pulse with the predetermined magnitude is sent through the inductor to the switching means.

13. The ballast system of claim 8, further comprising:

a second transformer having the inductor as a primary winding and having a secondary winding;

and an end-of-lamp-life cutoff circuit operably connected to the secondary winding and to the switching means, the end-of-lamp-life cutoff circuit having means for causing the switching means to inhibit current flow to the lamp when the pulse with the predetermined magnitude is sensed via the secondary winding.

14. The ballast system of claim 13, further comprising:

a second transformer having the inductor as a primary winding and having a secondary winding; and an end-of-lamp-life cutoff circuit having a third switch operably connected between the secondary winding of the second transformer and the switching means, the third switch operably configured to close when the pulse with the predetermined magnitude is sensed via the secondary winding.

15. The ballast system of claim 14, wherein the third switch is a DIAC.

16. The ballast system of claim 13, wherein the end-of-lamp-life circuit further comprises a transistor operably connected between the third switch and the switching means, the transistor having an on state and an off state, the transistor operably configured to enter the on state when the third switch is closed and to cause the switching means to inhibit current flow when the transistor is in the on state.

17. A ballast system for use with a fluorescent lamp having two filaments disposed at opposite ends of the lamp, comprising:

at least one AC input terminal for connection to an AC voltage source;

a rectifier operably connected to the at least one AC input terminal and having an output;

a capacitor operably connected between the rectifier and the lamp;

an inductor, the lamp operably connecting the capacitor in series with the inductor;

a transformer having a primary winding and a plurality of secondary windings;

a first power transistor having a first terminal operably connected to the output of the rectifier and to the capacitor, a second terminal, and a base terminal operably connected to one of the secondary windings, the primary winding being operably connected between the inductor and the second terminal of the power transistor; and a second power transistor having a first terminal operably connected to the second terminal of the first power transistor and a base terminal operably connected to another of the secondary windings and to the output of the rectifier, the second power transistor causing the first power transistor to control current from the rectifier to the capacitor in substantial synchronization with a change in voltage across the inductor when a first predetermined voltage level is present on the output of the rectifier.

18. The ballast system of claim 17, further comprising an end-of-lamp-life sensor operably connected across one of the two filaments of the lamp, the end-of-lamp-life sensor operably configured to detect when a second predetermined voltage level is present at one end of the one filament and to substantially short the one filament so that a pulse with a predetermined magnitude is sent through the inductor when the second predetermined voltage level is detected.

19. The ballast system of claim 18, further comprising:

a second transformer having the inductor as a primary winding and having a secondary winding; and an end-of-lamp-life cutoff circuit having a third switch operably connected between the secondary winding of the second transformer and the base of the second power transistor, the third switch operably configured to close when the pulse with the predetermined magnitude is sensed via the secondary winding.

20. The ballast system of claim 19, wherein the end-of-lamp-life circuit further comprises a transistor operably connected between the third switch and the base of the second power transistor, the transistor having an on state and an off state, the transistor operably configured to enter the on state when the third switch is closed and to turn off the second power transistor when the transistor is in the on state.

21. A protection apparatus for use with a ballast system operably connected to a fluorescent lamp, the ballast system having an inductor operably connected to one of two filaments of a fluorescent lamp, comprising:

a sensing means for detecting a predetermined voltage level at one end of one of the two filaments of the lamp and for sending a pulse having a predetermined magnitude through the inductor when the predetermined voltage level is detected at the one end of the two filaments; and a cutoff means operably associated with the inductor of the ballast system for causing the ballast system to inhibit current flow to the lamp when the pulse having the predetermined magnitude is sent through the inductor.

* * * * *